US009312595B2

(12) United States Patent
O'Neal

(10) Patent No.: US 9,312,595 B2
(45) Date of Patent: Apr. 12, 2016

(54) ANTENNA MOUNTING ASSEMBLY FOR A VEHICLE WITH A SLOPED BODY PANEL

(71) Applicant: Nissan North America, Inc., Franklin, TN (US)

(72) Inventor: Kenneth Brian O'Neal, Farmington Hills, MI (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 391 days.

(21) Appl. No.: 13/772,806

(22) Filed: Feb. 21, 2013

(65) Prior Publication Data

US 2014/0231612 A1 Aug. 21, 2014

(51) Int. Cl.
*H01Q 1/12* (2006.01)
*H01Q 1/32* (2006.01)

(52) U.S. Cl.
CPC ..... *H01Q 1/12* (2013.01); *H01Q 1/3258* (2013.01)

(58) Field of Classification Search
CPC ..... H01Q 1/12; H01Q 1/3258
See application file for complete search history.

(56) References Cited

U.S. PATENT DOCUMENTS 2,693,333 A * 11/1954 Race ..... H01Q 1/1214 174/153 A
2,899,485 A * 8/1959 Friedberg et al. ..... 174/153 A
2,965,340 A * 12/1960 Chadowski ..... 248/539
3,138,660 A 6/1964 Cejka
3,444,313 A 5/1969 Goodchild et al.
4,173,761 A * 11/1979 Liautaud ..... 343/715
4,190,839 A * 2/1980 Liautaud ..... 343/715
4,424,515 A 1/1984 Arbter et al.
4,431,332 A 2/1984 Dieges
4,945,361 A 7/1990 Egashira
5,233,363 A 8/1993 Yarsunas et al.
5,583,522 A * 12/1996 Radomski et al. ..... 343/715
5,896,110 A * 4/1999 Kojima ..... H01Q 1/1214 343/711
6,236,377 B1 5/2001 Hussaini et al.
7,338,316 B2 3/2008 Blickle
7,417,595 B2 8/2008 Jones
7,679,572 B2 * 3/2010 Gray et al. ..... 343/713
7,839,345 B2 11/2010 Kubacki et al.
8,102,322 B2 1/2012 Khreizat et al.
8,203,496 B2 * 6/2012 Miller ..... H01Q 1/1214 343/713

* cited by examiner

*Primary Examiner* — Jeanette E Chapman
(74) *Attorney, Agent, or Firm* — Young Basile Hanlon & MacFarlane P.C.

(57) ABSTRACT

Embodiments are provided of antenna mounting assemblies and vehicles that include such assemblies. In one aspect, an antenna mounting base for supporting a vehicle antenna with respect to a vehicle body panel that defines a panel aperture comprises: an antenna mounting portion; a flange extending from a surface of the antenna mounting base; and at least one tab defining a recess with the flange, the recess being sized and configured to mateably engage at least a portion of the body panel that borders the panel aperture.

17 Claims, 6 Drawing Sheets

ANTENNA MOUNTING ASSEMBLY FOR A VEHICLE WITH A SLOPED BODY PANEL

TECHNICAL FIELD

The embodiments disclosed herein generally relate to mounting assemblies used to support vehicle antennas.

BACKGROUND

Vehicle manufacturers may desire for a mast type antenna to extend in vertical orientation with respect to a fender or other body panel that forms a surface of a vehicle. In these applications, particularly where the surface of the vehicle is not normal to the axis of the antenna, vehicle manufacturers often provide an antenna mounting assembly configured for supporting the antenna with respect to the surface of the vehicle. Among other design considerations, it is desirable, for example, for such an antenna mounting assembly to include features for managing lateral forces acting on the antenna that arise during normal operation of the vehicle, for instance, through contact with strong winds, precipitation and car wash elements.

SUMMARY

Disclosed herein are embodiments of antenna mounting assemblies and vehicles that include such assemblies.

In one aspect, an antenna mounting base for supporting a vehicle antenna with respect to a vehicle body panel that defines a panel aperture comprises: an antenna mounting portion; a flange extending from a surface of the antenna mounting base; and at least one tab defining a recess with the flange, the recess being sized and configured to mateably engage at least a portion of the body panel that borders the panel aperture.

In another aspect, a vehicle having a vehicle antenna comprises: a vehicle body structure supporting a body panel defining a panel aperture; and an antenna mounting base at least partially extending through the panel aperture and comprising: a vehicle body structure connecting portion connected to the vehicle body structure, an antenna mounting portion positioned adjacent an exterior surface of the body panel, and an intermediate portion having a flange extending therefrom, the intermediate portion supporting at least one tab to define a recess with the flange, the recess being sized and configured to mateably engage at least a portion of the body panel that borders the panel aperture to couple the antenna mounting base to the body panel.

In yet another aspect, a vehicle having a vehicle antenna comprises: a vehicle body structure supporting a body panel defining a panel aperture, the panel aperture defined by a perimeter edge of the body panel, wherein the perimeter edge includes a first portion defining a small area portion of the panel aperture and a second portion defining a large area portion of the panel aperture; a longitudinal shaft at least partially extending through the panel aperture and comprising: a vehicle body structure connecting portion connected to the vehicle body structure, an antenna mounting portion positioned adjacent an exterior surface of the body panel, a flange extending from a partial circumferential portion of the shaft adjacent the first portion of the perimeter edge, and at least one tab to define a recess with the flange sized and configured to mateably engage at least a portion of the body panel that borders the panel aperture; and a finisher having a base positionable about the panel aperture on the exterior surface of the body panel, the finisher having a projection configured to extend beyond the base through the panel aperture between the second portion of the perimeter edge and the shaft and contacting at least one of the shaft and the flange.

These and other aspects will be described in additional detail below.

BRIEF DESCRIPTION OF THE DRAWINGS

The various features, advantages and other uses of the present apparatus will become more apparent by referring to the following detailed description and drawings in which.

DETAILED DESCRIPTION

Figure 1:
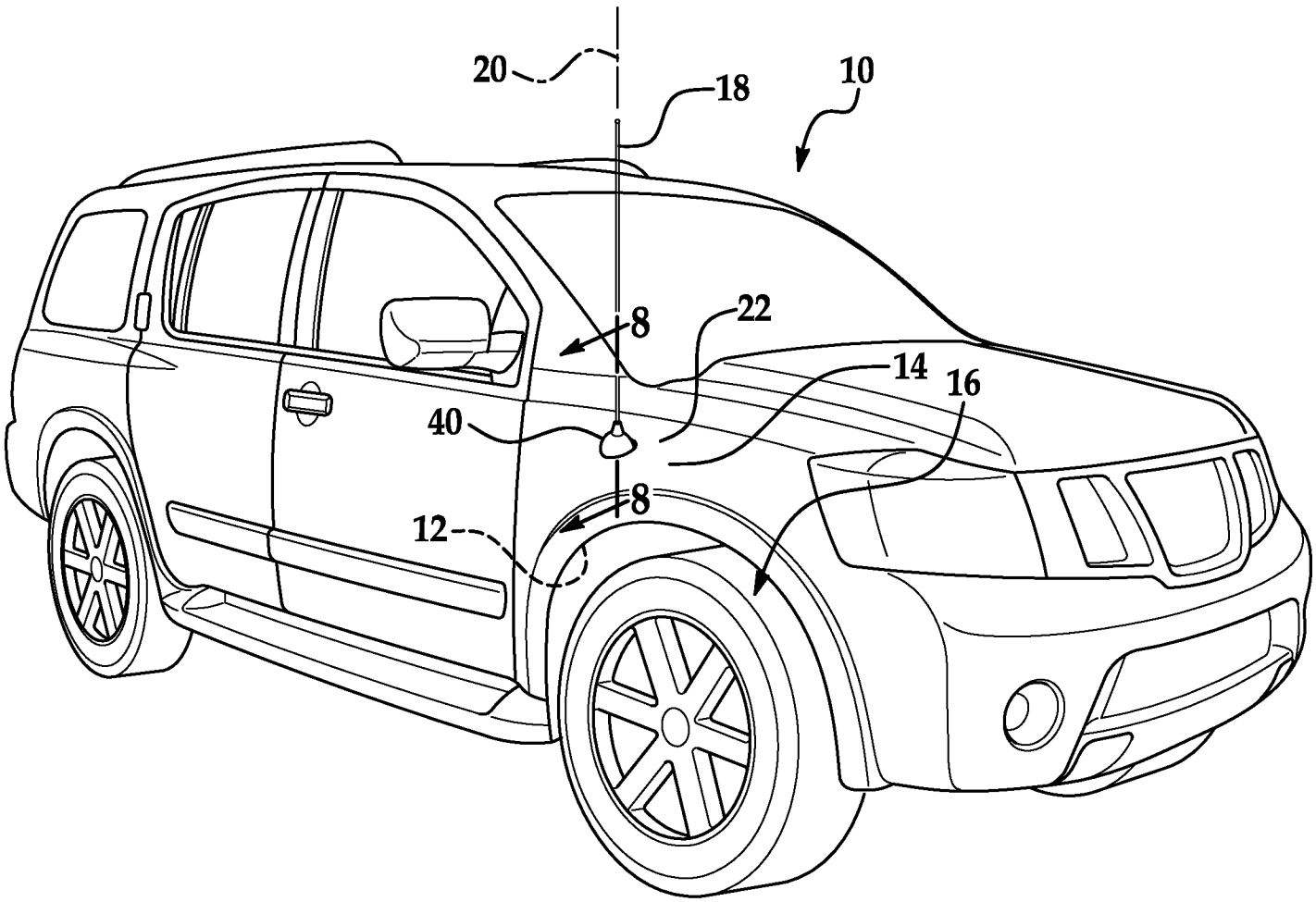
FIG. 1 is a perspective view of a vehicle having an antenna mounting assembly for supporting a mast type antenna with respect to a sloped body panel.

FIG. 1 depicts a vehicle 10 equipped with an antenna 18. The vehicle 10 includes a body structure 12 configured to at least partially support one or more exterior body panels 14 of the vehicle 10. The exemplary antenna 18 is shown as a mast type antenna oriented substantially vertically to extend from the body panel 14 along an axis 20. As shown in FIG. 1, the body panel 14 is a fender configured for framing a wheel well 16 of the vehicle 10. However, it will be understood that the illustrated body panel 14 is given as a non-limiting example, and that the inventive aspects disclosed herein are applicable in principle to other body panels of the vehicle 10. As explained in greater detail below, an antenna mounting assembly 40 is configured for supporting the antenna 18 with respect to the body panel 14.

Due to design or other criteria for the vehicle 10 and/or the antenna 18, an outer surface 22 of the body panel 14 may be shaped in such a way that the body panel 14 is not substantially perpendicular to the axis 20 at a position from which the antenna 18 extends. As shown, the antenna 18 extends from an oblique portion of the body panel 14 that is oriented with a predominantly vertical slope, while the antenna 18 extends from the body panel 14 in a substantially vertical orientation at an angle from a surface normal to the axis 20. In such a design, it is desirable, for example, for the antenna mounting assembly 40 to include features for managing lateral forces acting on the antenna 18 that arise during normal operation of the vehicle 10. These forces may arise, for instance, through contact with strong winds, precipitation and car wash elements.

Figure 2A:
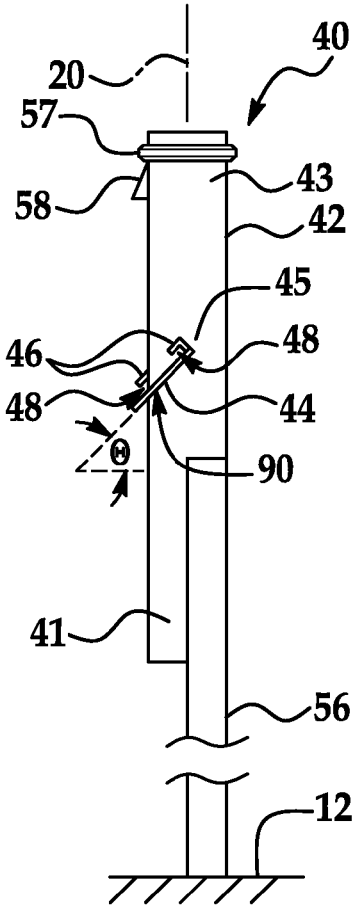
FIG. 2A is a side view of an antenna mounting base.
Figure 2B:
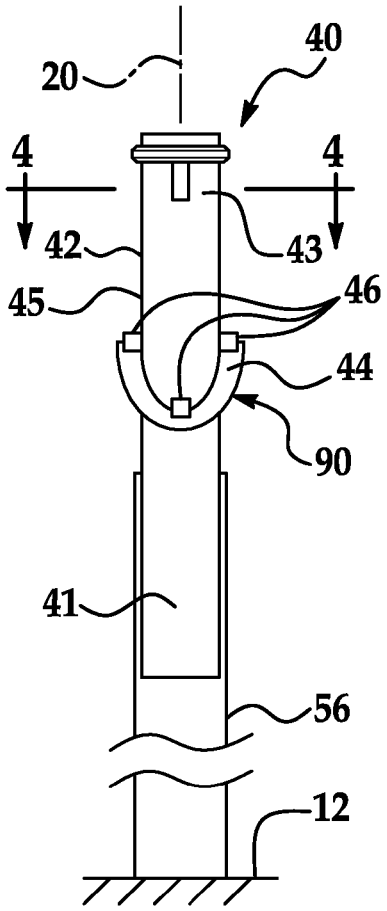
FIG. 2B is a front view of the antenna mounting base.
Figure 8:
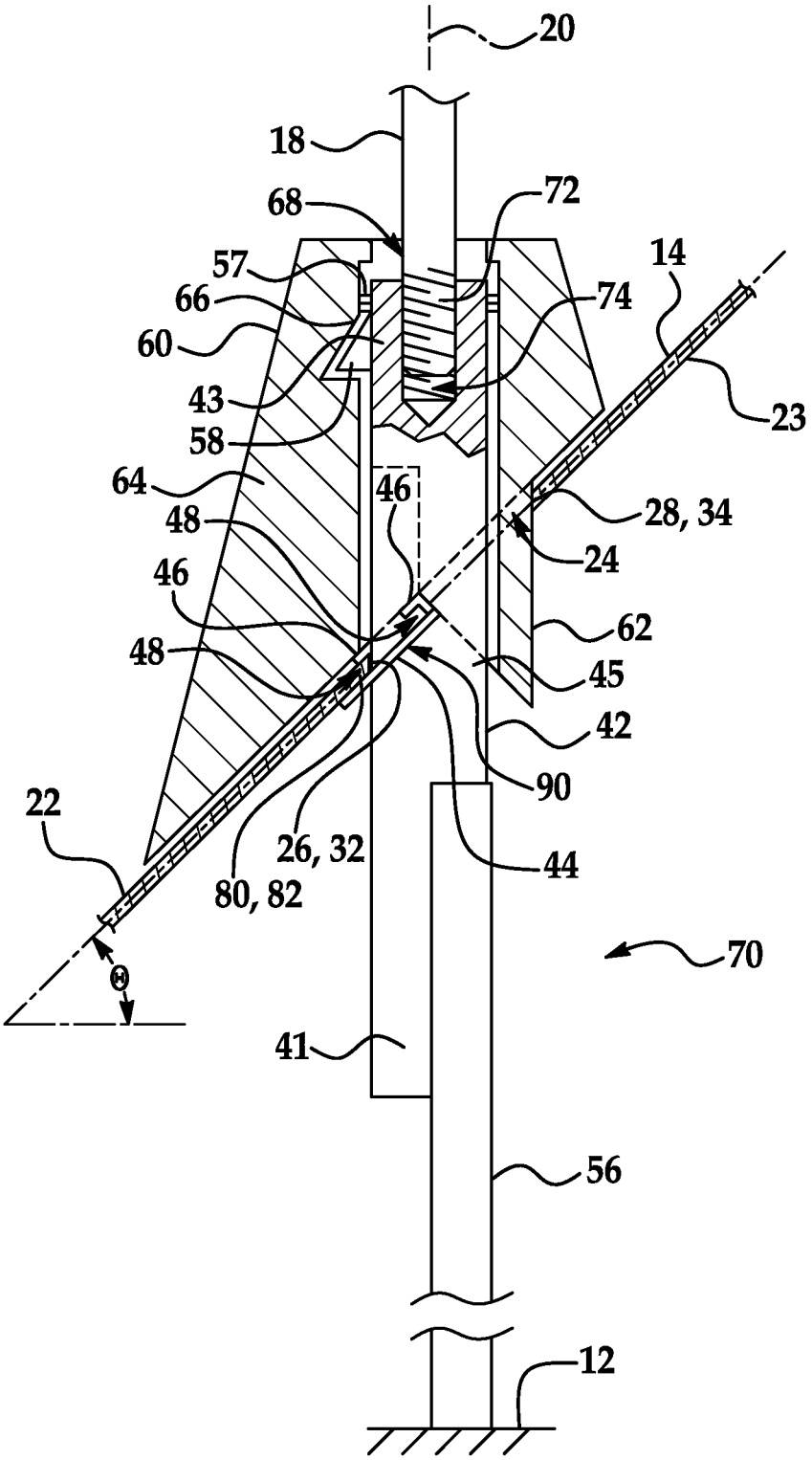
FIG. 8 is a partial cross section view of the antenna mounting assembly, including the antenna mounting base and the finisher, taken along the line 8-8 in FIG. 1.

With further reference to FIGS. 2A, 2B and 8, the antenna mounting assembly 40 can comprise an antenna mounting base 42. The antenna mounting base 42 is generally configured to support the antenna 18 with respect to the body panel 14, and optionally, with respect to the vehicle body structure 12. The antenna mounting assembly 40 is suitable for supporting the antenna 18 where, as depicted in the Figures, the antenna 18 extends along the axis 20, and the body panel 14 is disposed at an angle Θ from a surface normal to the axis 20 at a position from which the antenna 18 extends. As explained below, the antenna mounting base 42 includes features for managing different loads resulting from lateral or other forces acting on the antenna 18.

As shown, the antenna mounting base 42 may be coupled between the vehicle body structure 12 and the body panel 14, and is configured to provide a sturdy mounting point for the vehicle antenna 18. In the embodiments incorporated herein, the antenna mounting base 42 extends at least partially through an aperture 24 defined by the body panel 14. As depicted in FIGS. 2A and 2B, the antenna mounting base 42 includes an antenna mounting portion 43 and a vehicle body structure connecting portion 41. The vehicle body structure connecting portion 41 is generally configured for connection to the body structure 12. As shown, the vehicle body structure connecting portion 41 is configured to occupy a space 70 between the vehicle body structure 12 and an underside 23 of the body panel 14. In one non-limiting example, the vehicle body structure connection portion 41 may be coupled directly to the vehicle body structure 12. The vehicle body structure connection portion 41 may be welded, fastened, or adhered to the vehicle body structure 12, for example, although other techniques may be used as desired. Alternatively, as shown, the antenna mounting assembly 40 can include an attachment bracket 56 configured for connecting the vehicle body structure connection portion 41 to the vehicle body structure 12, and additionally can provide a grounding connection to the body structure 12. The illustrated attachment bracket 56 can be connected at one end to the vehicle body structure connection portion 41, and to one or more areas of the body structure 12 at a second end, for example, using the techniques set forth above.

The antenna mounting portion 43 is configured to provide a mounting point for the vehicle antenna 18. In the illustrated example, the antenna mounting portion 43 defines a longitudinally extending threaded aperture 74 configured to receive external threads formed on a distal end 72 of the antenna 18. In this example, the antenna mounting base 42 at least partially extends through the panel aperture 24 such that the antenna mounting portion 43 is accessible from an exterior side 22 of the body panel 14, to permit selective installation or removal of the antenna 18 with respect to the antenna mounting base 42 by a user of the vehicle. It will be understood that this is provided as a non-limiting example, and that the antenna mounting portion 43 can include any other attachment mechanism to secure the illustrated or other antennas 18 to the antenna mounting base 42.

As depicted in the embodiments in the Figures herein, the antenna mounting base 42 is generally configured as a longitudinally extending tubular shaft. As shown, the vehicle body structure connecting portion 41 is disposed on a first distal end of the antenna mounting base 42, the antenna mounting portion 43 is disposed on an opposing second distal end, and the antenna mounting base 42 includes an intermediate portion 45 between the vehicle body structure connecting portion 41 and the antenna mounting portion 43. The antenna mounting base 42 can extend coaxially with the antenna 18, in the same substantially vertical orientation, as the axis 20. The intermediate portion 45 is circumscribed by a portion 80 of the body panel 14 that borders the aperture 24 when the antenna mounting base 42 is in its final assembled position, as described in further detail below.

As shown in FIGS. 2A and 2B, the antenna mounting base 42 includes features for securing the antenna mounting base 42 to the body panel 14 when the antenna mounting assembly 40 is fully assembled to the vehicle 10. The illustrated antenna mounting base 42 includes a retaining structure 90 located at the intermediate portion 45 of the antenna mounting base 42. As shown, the retaining structure 90 comprises a flange 44 and one or more tabs 46 supported by the antenna mounting base 42. The flange 44 extends radially from at least a partial circumferential portion of a surface of the antenna mounting base 42 at the intermediate portion 45. As depicted in FIG. 2A and FIG. 8, the flange 44 can be oriented at the angle Θ with respect to a plane normal to the axis 20 of the antenna 18, so that the flange 44 extends at an angle from the surface of the antenna mounting base 42 to generally lie parallel to a plane of the body panel 14. The flange 44 is generally U-shaped and extends around approximately half the circumference, or 180 degrees, of the antenna mounting base 42, although the flange 44 may be alternatively shaped and/or configured to support the one or more tabs 46. As shown, the flange 44 is longitudinally disposed with respect to the antenna mounting base 42 for positioning in the space 70 between the vehicle body structure 12 and the body panel 14 in abutment with the underside 23 of body panel 14. Furthermore, the flange 44 may be shaped to approximate a contour of the underside 23 of the body panel 14 to which the flange 44 abuts.

Figure 3:
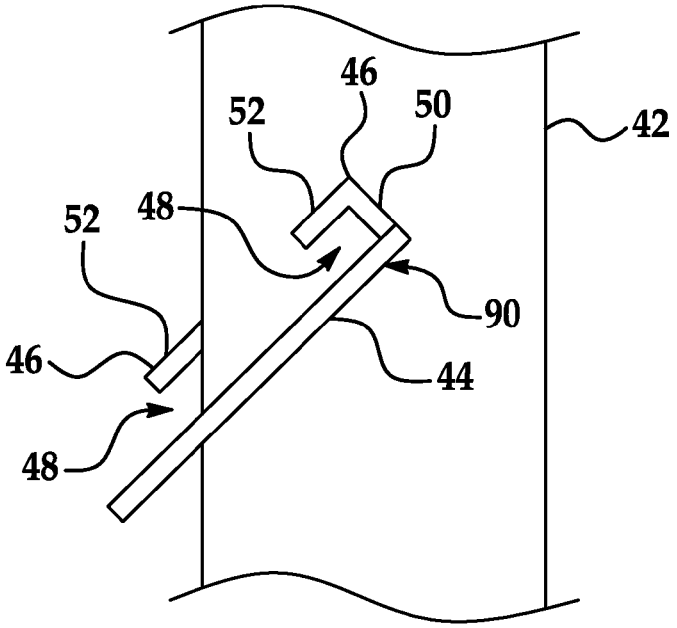
FIG. 3 is a close up side view of the antenna mounting base showing details of a flange supporting a plurality of tabs.
Figure 4:
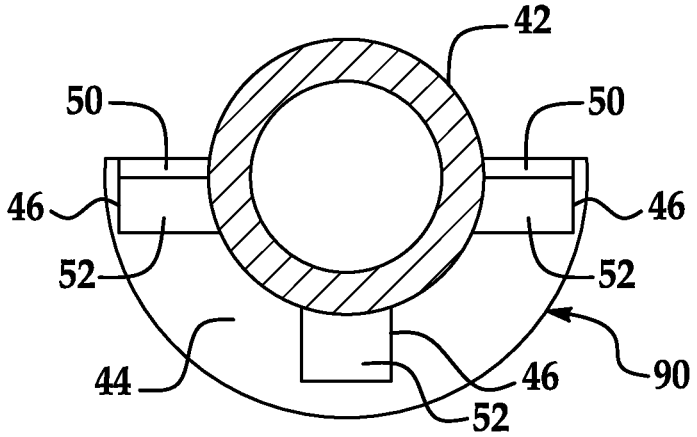
FIG. 4 is a cross section view of the antenna mounting base taken along the line 4-4 in FIG. 2B showing details of the flange and the plurality of tabs.

Turning now to FIGS. 3 and 4, each tab 46 is explained in further detail. Each of the one or more tabs 46 is supported by the antenna mounting base 42 adjacent the intermediate portion 45 to define a recess 48 at least partially with the flange 44. In one illustrated example, the tabs 46 may include a first wall 50 extending generally normally from the flange 44 from a position proximate to the antenna mounting base 42, and a second wall 52 extending from a distal portion of the first wall 50 and substantially parallel to the flange 44. As shown, the second wall 52 can additionally extend to, and optionally attach to, a surface of the intermediate portion 45 of the antenna mounting base 45. In this example, the tabs 46 are supported by the antenna mounting base 42 via the flange 44, and for each tab 46, a recess 48 is defined between the flange 44 and the first and second walls 50 and 52 of the tab 46. In another illustrated example, a tab 46 may include only a second wall 52 extending from the intermediate portion 45 of the antenna mounting base 42 to define a recess 48 between the flange 44, the second wall 52 and the intermediate portion 45 of the antenna mounting base 42. As explained below with reference to FIGS. 5A, 5B, 6A and 6B, the recesses 48 open towards one or more portions of a perimeter edge 30 of the panel aperture 24, and may be sized and configured for receiving a portion 80 of the body panel 14 that borders the panel aperture 24 when the antenna mounting base 42 is in its final assembled position.

Figure 5A:
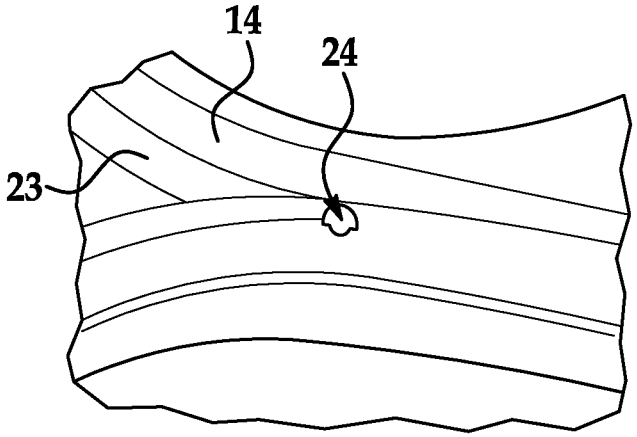
FIG. 5A is a perspective view of the vehicle body panel showing a panel aperture defined therein configured for receiving the antenna mounting base.
Figure 5B:
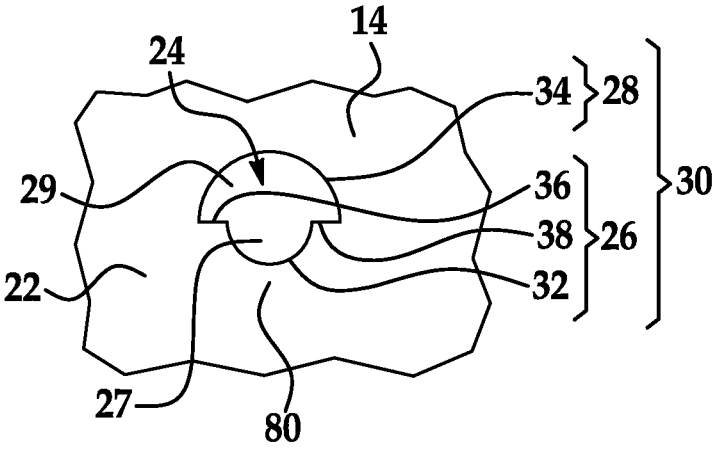
FIG. 5B is a plan view of the panel aperture defined by the body panel.

FIGS. 5A and 5B illustrate the panel aperture 24 that may be utilized by embodiments of the antenna mounting assembly 40 as described herein. The panel aperture 24 is defined by the body panel 14 and can be stamped, drilled, cut, or formed therein in any way known to those in the art. In general, the panel aperture 24 may be sized and shaped so that a portion 80 of the body panel 14 bordering the panel aperture 24 seats within the recesses 48 in mateable engagement to couple the antenna mounting base 42 to the body panel 14. In addition, the size and shape of the panel aperture 24 can accommodate installation of the antenna mounting base 42 during assembly of the vehicle 10, as explained below.

A profile of the illustrated panel aperture 24 is generally defined by a perimeter edge 30 of the body panel 14 to include both a small area portion 27 and a large area portion 29. The perimeter edge 30 includes first and second opposing concentric half circular segments 32 and 34, which have different diameters and are interconnected by a pair of generally diametrically opposed radial segments 36 and 38, as can be seen in FIG. 5B. The small area portion 27 of the panel aperture 24 is defined by a first portion 26 of the perimeter edge 30. The first portion 26 of the perimeter edge 30 includes the first half circular segment 32 and the pair of opposed radial segments 36 and 38, and is configured for positioning into the recesses 48 of the one or more tabs 46. The large area portion 29 is defined by a second portion 28 of the perimeter edge 30 that includes the second half circular segment 34, which, as shown, has a relatively larger diameter than the first half circular segment 32.

Figure 6A:
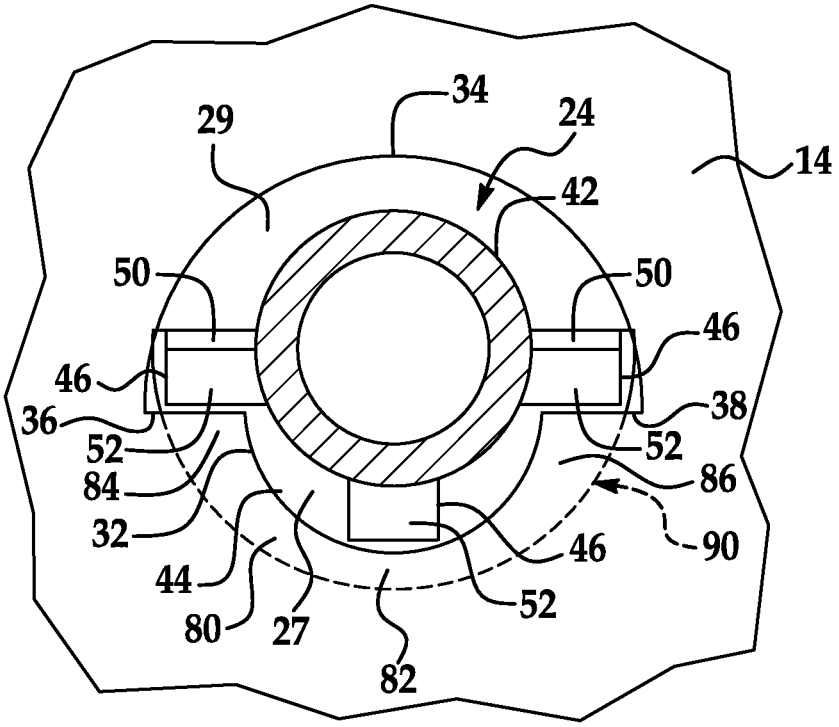
FIG. 6A is a cross section view of the antenna mounting base taken at a position similar to line 4-4 in FIG. 2B and showing details of installation through the panel aperture and to the body panel.
Figure 6B:
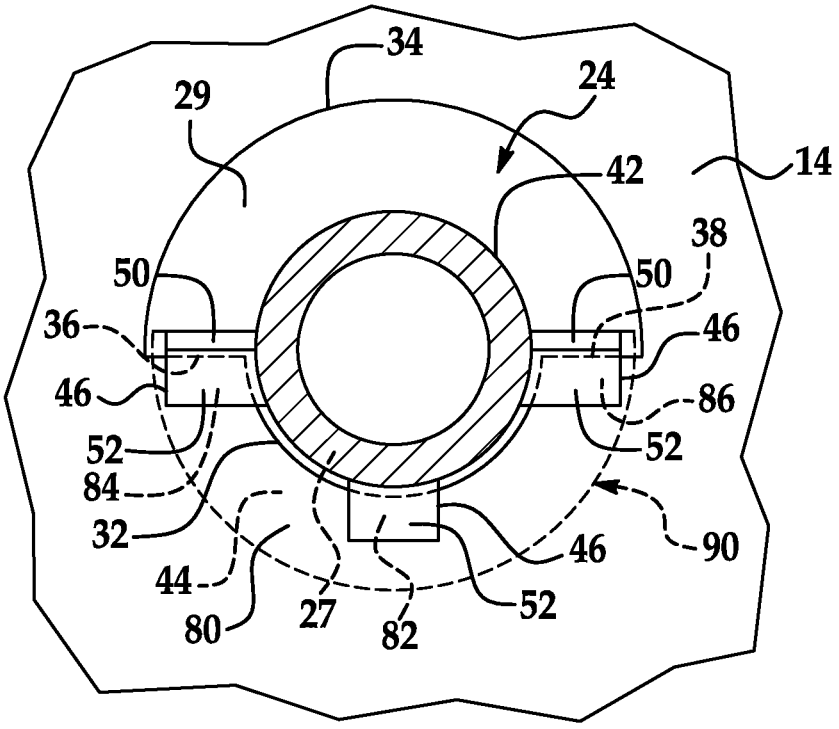
FIG. 6B is a cross section view of the antenna mounting base taken at a position similar to line 4-4 in FIG. 2B and showing further details of installation to the body panel.

With additional reference to FIGS. 6A and 6B, it can be seen that the panel aperture 24 is sized and shaped to permit receipt of the antenna mounting portion 43 from the underside 23 of the body panel 14, and to allow clearance for the tabs 46 to receive the portion 80 of the body panel 14 bordering the panel aperture 24.

As shown in FIG. 6A, the illustrated antenna mounting base 42 can be installed and attached to the body panel 14 by first inserting the antenna mounting portion 43 of the antenna mounting base 42 primarily through the large area portion 29 of the panel aperture 24, from the underside 23 of the body panel 14. The antenna mounting base 42 can be inserted until the second walls 52 of the tabs 46 rise through the panel aperture 24 and the recesses 48 formed by the tabs 46 and flange 44 are aligned with the first portion 26 of the perimeter edge 30. The large area portion 29 is therefore sized to allow clearance for the antenna mounting base 42 and the one or more tabs 46 to pass through the panel aperture 24 during installation so that the antenna mounting base 42 can be moved toward the first portion 26 of the perimeter edge 30 until the first portion 26 of the perimeter edge 30 is positioned within the recesses 48 of the one or more tabs 46.

Additionally, the flange 44 can be sized to contact the underside 23 of the body panel 14 while the antenna mounting base 42 and the one or more tabs 46 are passing through the panel aperture 24 to provide an indication that the one or more tabs 46 are in the correct positioning with respect to the panel aperture 24 to receive the first portion 26 of the perimeter edge 30 within the recesses 48 of the one or more tabs 46, and to prevent the antenna mounting base 42 from moving past the correct position.

It can be seen from FIG. 6B that the antenna mounting base 42 can then be moved translationally in a plane of the body panel 14 in a direction toward the small area portion 27 of the panel aperture 24 to move the recesses 48 towards the first portion 26 of the perimeter edge 30. In the illustrated installed position, the antenna mounting base 42 is positioned such that the intermediate portion 45 of the antenna mounting base 42 seats against the first half circular segment 32 of the first portion 26 of the perimeter edge 30, and such that the portion 80 of the body panel 14 bordering the first portion 26 of the perimeter edge 30 is received within the recesses 48. Each of the tabs 46 are generally configured to receive the portion 80 of the body panel 14 bordering the first portion 26 of the perimeter edge 30 of the panel aperture 24 in mateable engagement within the respective recesses 48. The one or more tabs 46 are thus configured to provide one or more points of contact with the body panel 14 to couple the antenna mounting base 42 to the body panel 14. In general, these contact points collectively restrict movement of antenna mounting base 42 with respect to the body panel 14 and the panel aperture 24. Additionally, these contact points may be configured so that the tabs 46 restrict rotation of the antenna mounting base 42 about the axis 20 within the panel aperture 24.

In the embodiment shown throughout the Figures, the antenna mounting base 42 supports three tabs 46, each providing a point of contact with the body panel 14. The three tabs 46 are substantially equally spaced circumferentially with respect to each other along the flange 44. A first tab 46 can be positioned at an apex of the flange 44, to define with the flange 44 a first recess 48 configured for receiving a first part 82 of the portion 80 of the body panel 14 that borders the panel aperture 24. In particular, the part 82 borders an apex of the first half circular segment 32 partially defining the first portion 26 of the perimeter edge 30 of the panel aperture 24. A second tab 46 can be positioned proximate to a first distal end of the flange 44 to define with the flange 44 a second recess 48 configured for receiving a second part 84 of the portion 80 of the body panel 14 that borders the panel aperture 24. Specifically, the second part 84 borders the radial segment 36 that partially defines the first portion 26 of the perimeter edge 30 of the panel aperture 24. A third tab 46 can be positioned proximate to a second distal end of the flange 44 opposite the first end to define with the flange 44 a third recess 48 configured for receiving a third part 86 of the portion 80 of the body panel 14 that borders the panel aperture 24. As shown, the third part 86 borders the radial segment 38 that partially defines the first portion 26 of the perimeter edge 30 of the panel aperture 24.

As explained above, the tabs 46 can be differently supported by the antenna mounting base 42 depending, for example, on the position of a particular tab 46 with respect to the flange 44. The first tab 46, for instance, extends from the intermediate portion 45 of the antenna mounting base 42, while the second and third tabs are supported by the antenna mounting base 42 via the flange 44. While three tabs 46 are described in embodiments herein, it is also contemplated that a variety of numbers of tabs 46 may be formed, depending, for instance, on the amount and spacing of contact points to the body panel 14 that are desired. In addition, it will be understood that a single tab 46 could be configured to produce multiple contact points with the body panel 14, if desired. Also, it will be understood that the antenna mounting base 42 and/or flange 44 could have a single tab 46 in a shape corresponding to a shape of the first portion 26 of the peripheral edge 30.

The antenna mounting base 42 can be installed as directed above subsequent to attaching the antenna 18 to the antenna mounting portion 43, or the antenna 18 can be attached after the antenna mounting base 42 is installed. Similarly, the antenna mounting base 42 can be installed with the attachment bracket 56 attached, or the two may be attached after the antenna mounting base 42 is installed.

Figure 7A:
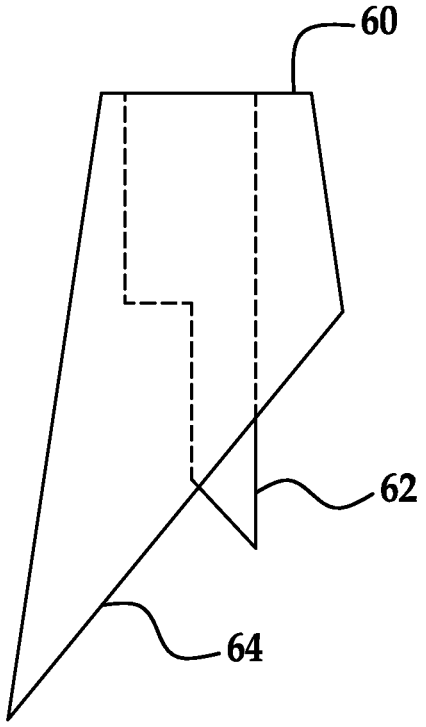
FIG. 7A is a cross section view of a finisher positionable about the antenna mounting base on an exterior surface of the body panel.
Figure 7B:
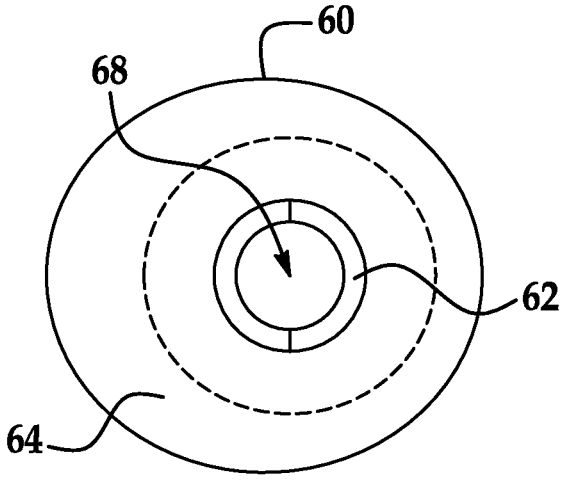
FIG. 7B is a bottom view of the finisher.

As shown in FIGS. 7A and 7B, the antenna mounting assembly 40 can include a finisher 60. The finisher 60 is generally configured to be positioned adjacent the exterior surface 22 of the body panel 14. As shown, the finisher 60 defines an interior channel 68 configured to substantially receive and enclose the intermediate portion 45 and the antenna mounting portion 43 of the antenna mounting base 42. The finisher 60 is generally frustoconical in shape and extends longitudinally substantially along the axis 20. The finisher 60 can include a finisher base 64 tapered at the angle Θ to generally correspond with the slope of the oblique portion of the body panel 14, such that the finisher 60 can sit flush against the exterior surface 22 of the body panel 14 and substantially enclose the panel aperture 24 once installed.

The finisher 60 may be attached and retained to the antenna mounting base 42 through any reasonable means. As shown in FIG. 8, the finisher 60 is attached to the antenna mounting base 42 at or near the antenna mounting portion 43. In the illustrated example, the finisher 60 defines a pocket 66 in communication with the interior channel 68 that is sized and configured to receive a projection 58 positioned on the antenna mounting portion 43. Optional ridges 57 extend radially outward from the antenna mounting portion 43 to contact the finisher 60 in the interior channel 68 to provide a weatherproof seal between the finisher 60 and the antenna mounting base 42, as well as additional retention of the finisher 60.

During installation of the antenna mounting base 42 as described above, the large area portion 29 of the panel aperture 24 is partially vacated as the antenna mounting base 42 is moved toward the small area portion 27 to position the tabs 46 into engagement with the portion 80 of the body panel 14 bordering the first portion 26 of the perimeter edge 30 of the panel aperture 24. The illustrated finisher 60 includes a projection 62 that is configured to extend beyond the base 64 through the panel aperture 24 to occupy at least a portion of the vacated large area portion 29 following installation of the antenna mounting base 42. In particular, as shown in FIG. 8, the projection 62 is configured to occupy at least a portion of a space between the antenna mounting base 42 and the second portion 28 of the perimeter edge 30 of the panel aperture 24.

As shown in FIG. 8, the projection 62 is configured to inhibit movement of the antenna mounting base 42 away from the small area portion 27 of the panel aperture and into the large area portion 29, so that engagement of the portion 80 of the body panel 14 bordering the first portion 26 of the perimeter edge 30 of panel aperture 24 within the recesses 48 is maintained. To do so, the projection 62 can be configured to extend between and contact the perimeter edge 30 of the panel aperture 24 and at least one of the antenna mounting base 42 and one or more portions of the flange 44. The illustrated projection 62, for example, is contoured such that the projection 62 can be "sandwiched" between the antenna mounting base 42, the first and second distal ends of the flange 44, and the second portion 28 of the perimeter edge 30 defining the large area portion 29 of the panel aperture 24. Projection 62 can also be tapered, to aid insertion between the body panel 14 and antenna mounting base 42 and/or the flange 44. In FIG. 8, the projection 62 is shown to be tapered toward a distal end that is opposite the base 64 in a direction normal to the taper of the base 64. A surface extending along the taper of the projection 62 can contact the flange 44 as shown in FIG. 8, and slide along the flange 44 while the finisher 60 is installed onto the antenna mounting base 42, which pushes the projection 62 toward the second portion 28 of the perimeter edge 30 while also pushing the one or more tabs 46 of the flange 44 toward the first portion 26 of the perimeter edge 30 to provide a snug fit from the first portion 26 of the perimeter edge 30 through the flange 44, the antenna mounting base 42, and the projection 62 to the second portion 28 of the perimeter edge 30.

The finisher 60 as disclosed herein can be created as a single piece having the base 64, the projection 62, and the interior channel 68, otherwise the finisher may be composed of multiple components attached to one another. Furthermore, the base 64 or the whole finisher 60 can be composed of an elastomeric material sized to allow slight deformation during fitment within the panel aperture 24.

The first portion 26 of the peripheral edge 30 can form the small area portion 27 in any orientation within the panel aperture 24. However, it may be preferred to have the first portion 26 of the peripheral edge 30 form the small diameter portion 27 at the bottom of the panel aperture 24 such that the first walls 50 of the tabs 46 are oriented substantially above and over the first portion 26 of the peripheral edge 30. That way, the antenna mounting base 42 may be temporarily held in place through engagement of the tabs 46 to the portion 80 of the body panel 14 via gravity prior to installation of the finisher 60 onto the antenna mounting base 42.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A vehicle having a vehicle antenna, comprising:

a vehicle body structure supporting a body panel defining a panel aperture, the panel aperture defined by a perimeter edge of the body panel, wherein the perimeter edge includes a first portion defining a small area portion of the panel aperture and a second portion defining a large area portion of the panel aperture the aperture extending at an oblique angle to an axis of the vehicle antenna; and an antenna mounting base at least partially extending through the panel aperture and comprising:

a vehicle body structure connecting portion connected to the vehicle body structure, an antenna mounting portion positioned adjacent an exterior surface of the body panel, and an intermediate portion having a flange extending therefrom, the intermediate portion supporting at least one tab to define a recess with the flange, the at least one tab extending downward at the oblique angle to the axis of the vehicle antenna, the recess being sized and configured to mateably engage at least a portion of the body panel that borders the panel aperture to couple the antenna mounting base to the body panel, and the recess being further configured for receiving a portion of the body panel bordering the small area portion of the panel aperture.

2. The vehicle of claim 1, wherein the flange extends from the antenna mounting base to abut an underside of the body panel.

3. The vehicle of claim 1, wherein the tab is comprised of a first wall extending from the flange adjacent the antenna mounting base through the panel aperture and a second wall extending from a distal portion of the first wall substantially parallel to the flange, in abutment with the exterior surface of the panel.

4. The antenna mounting assembly of claim 1, wherein the tab is comprised of a wall extending from the intermediate portion substantially parallel to the flange and in abutment with the exterior surface of the panel.

5. The vehicle of claim 1, wherein the flange extends from a partial circumferential portion of a surface of the antenna mounting base adjacent the first portion of the perimeter edge and includes first and second distal ends.

6. The vehicle of claim 5, wherein:

the intermediate portion supports a first tab between the first and second distal ends of the flange;

the flange supports a second tab proximate to the first distal end of the flange and a third tab proximate to the second distal end of the flange; and each tab defines with the flange respective first, second and third recesses configured to receive different portions of the body panel bordering the first portion of the perimeter edge.

7. The vehicle of claim 6, wherein:

a profile of the panel aperture at the perimeter edge is defined by two opposing concentric half circular segments having different diameters and interconnected by a pair of opposed radial segments; and the first portion of the perimeter edge includes a first of the half circular segments and the pair of opposed radial segments, and the second portion of the perimeter edge includes a second of the half circular segments having a relatively larger diameter than the first half circular segment.

8. The vehicle of claim 7, wherein the first recess is configured for receiving a portion of the body panel bordering an apex of the first of the half circular segments, the second recess is configured for receiving a portion of the body panel bordering a first of the radial segments, and the third recess is configured for receiving a portion of the body panel bordering a second of the radial segments.

9. The vehicle of claim 1, wherein the large area portion is larger than a width of the antenna mounting portion and the at least one tab.

10. The vehicle of claim 9, further comprising:

a finisher having a base positionable about the panel aperture on the exterior surface of the body panel, the finisher having a projection configured to extend beyond the base through the panel aperture between the second portion of the perimeter edge and the antenna mounting base and contacting at least one of the antenna mounting base and the flange.

11. A vehicle having a vehicle antenna, comprising:

a vehicle body structure supporting a body panel defining a panel aperture, the panel aperture defined by a perimeter edge of the body panel, wherein the perimeter edge includes a first portion defining a small area portion of the panel aperture and a second portion defining a large area portion of the panel aperture;

a longitudinal shaft at least partially extending through the panel aperture and comprising:

a vehicle body structure connecting portion connected to the vehicle body structure, an antenna mounting portion positioned adjacent an exterior surface of the body panel, a flange extending from only a partial circumferential portion of the shaft adjacent the first portion of the perimeter edge, and at least one tab to define a recess with the flange sized and configured to mateably engage at least a portion of the body panel that borders the panel aperture; and a finisher having a base with a circumference positionable to surround the panel aperture on the exterior surface of the body panel, the finisher having a projection configured to extend beyond the base through the panel aperture between the second portion of the perimeter edge and the shaft and contacting at least one of the shaft and the flange.

12. A vehicle having a vehicle antenna, comprising:

a vehicle body structure supporting a body panel defining a panel aperture; and an antenna mounting base at least partially extending through the panel aperture and comprising:

a vehicle body structure connecting portion connected to the vehicle body structure;

an antenna mounting portion positioned adjacent an exterior surface of the body panel; and an intermediate portion having a flange extending therefrom, the intermediate portion supporting at least one tab to define a recess with the flange, the recess being sized and configured to mateably engage at least a portion of the body panel that borders the panel aperture to couple the antenna mounting base to the body panel;

wherein, the panel aperture is defined by a perimeter edge of the body panel, wherein the perimeter edge includes a first portion defining a small area portion of the panel aperture and a second portion defining a large area portion of the panel aperture;

the recess is configured for receiving a portion of the body panel bordering the first portion of the perimeter edge;

the flange extends from a partial circumferential portion of a surface of the antenna mounting base adjacent the first portion of the perimeter edge and includes first and second distal ends;

the intermediate portion supports a first tab between the first and second distal ends of the flange;

the flange supports a second tab proximate to the first distal end of the flange and a third tab proximate to the second distal end of the flange; and each tab defines with the flange respective first, second and third recesses configured to receive different portions of the body panel bordering the first portion of the perimeter edge.

13. The vehicle of claim 12, wherein:

a profile of the panel aperture at the perimeter edge is defined by two opposing concentric half circular segments having different diameters and interconnected by a pair of opposed radial segments; and the first portion of the perimeter edge includes a first of the half circular segments and the pair of opposed radial segments, and the second portion of the perimeter edge includes a second of the half circular segments having a relatively larger diameter than the first half circular segment.

14. The vehicle of claim 13, wherein the first recess is configured for receiving a portion of the body panel bordering an apex of the first of the half circular segments, the second recess is configured for receiving a portion of the body panel bordering a first of the radial segments, and the third recess is configured for receiving a portion of the body panel bordering a second of the radial segments.

15. The vehicle of claim 1, wherein the small area portion is lower than and outboard of the large area portion.

16. The vehicle of claim 11, wherein the projection contacts the perimeter edge and the at least one tab to maintain engagement of the at least one tab to the portion of the body panel that borders the panel aperture.

17. The vehicle of claim 16, wherein:

the at least one tab comprising:

a first tab at a first distal end of the flange, and a second tab at a second distal end of the flange; and the projection contacts the first tab and the second tab.

* * * * *